US011254335B2

(12) United States Patent
Ma et al.

(10) Patent No.: US 11,254,335 B2
(45) Date of Patent: Feb. 22, 2022

(54) BOGIE OF A RAIL VEHICLE WITH AT LEAST TWO WHEELSETS MOUNTED IN AXLEBOXES AND AT LEAST ONE TRANSVERSE MEMBER

(71) Applicants: CRRC QINGDAO SIFANG CO., LTD., Shandong (CN); CG RAIL—CHINESISCH-DEUTSCHES FORSCHUNGS—UND ENTWICKLUNGSZENTRUM FÜR BAHN—UND VERKEHRSTECHNIK, Dresden (DE)

(72) Inventors: Lijun Ma, Shandong (CN); Pingyu Zhou, Shandong (CN); Houli Sun, Shandong (CN); Xiongfei Zhang, Shandong (CN); Yunjie Fan, Shandong (CN); Xiaoming Wang, Shandong (CN); Werner Hufenbach, Dresden (DE); Andreas Ulbricht, Dresden (DE)

(73) Assignees: CRRC QINGDAO SIFANG CO., LTD., Shandong (CN); CG RAIL—CHINESISCH-DEUTSCHES FORSCHUNGS—UND ENTWICKLUNGSZENTRUM FÜR BAHN—UND VERKEHRSTECHNIK DRESDEN GMBH, Dresden (DE)

( * ) Notice: Subject to any disclaimer, the term of this patent is extended or adjusted under 35 U.S.C. 154(b) by 354 days.

(21) Appl. No.: 16/467,487

(22) PCT Filed: Dec. 7, 2017

(86) PCT No.: PCT/EP2017/081853
§ 371 (c)(1),
(2) Date: Jun. 6, 2019

(87) PCT Pub. No.: WO2018/104463
PCT Pub. Date: Jun. 14, 2018

(65) Prior Publication Data

US 2019/0322296 A1 Oct. 24, 2019

(30) Foreign Application Priority Data

Dec. 8, 2016 (DE) ..... 10 2016 123 784.1

(51) Int. Cl.
*B61F 3/02* (2006.01)
*B61F 5/30* (2006.01)
*B61F 5/52* (2006.01)

(52) U.S. Cl.
CPC ..... *B61F 3/02* (2013.01); *B61F 5/30* (2013.01); *B61F 5/52* (2013.01)

(58) Field of Classification Search
CPC ..... B61F 3/02; B61F 5/30; B61F 5/52
See application file for complete search history.

(56) References Cited

U.S. PATENT DOCUMENTS 3,948,188 A * 4/1976 Zehnder ..... B60G 11/04 105/167
4,194,761 A * 3/1980 Falk ..... B60G 11/185 267/284

(Continued)

FOREIGN PATENT DOCUMENTS

CA 2091291 C 5/2001
DE 920291 C 11/1954

(Continued)

OTHER PUBLICATIONS

International Search Report for PCT/EP2017/081853 dated May 25, 2018 , ISA/EPO.

(Continued)

*Primary Examiner* — Jason C Smith
(74) *Attorney, Agent, or Firm* — Yue (Robert) Xu; Apex Attorneys at Law, LLP

(57) ABSTRACT

The invention relates to bogies for railway vehicles with at least two wheelsets mounted in axleboxes and at least one (Continued)

Figure 1:
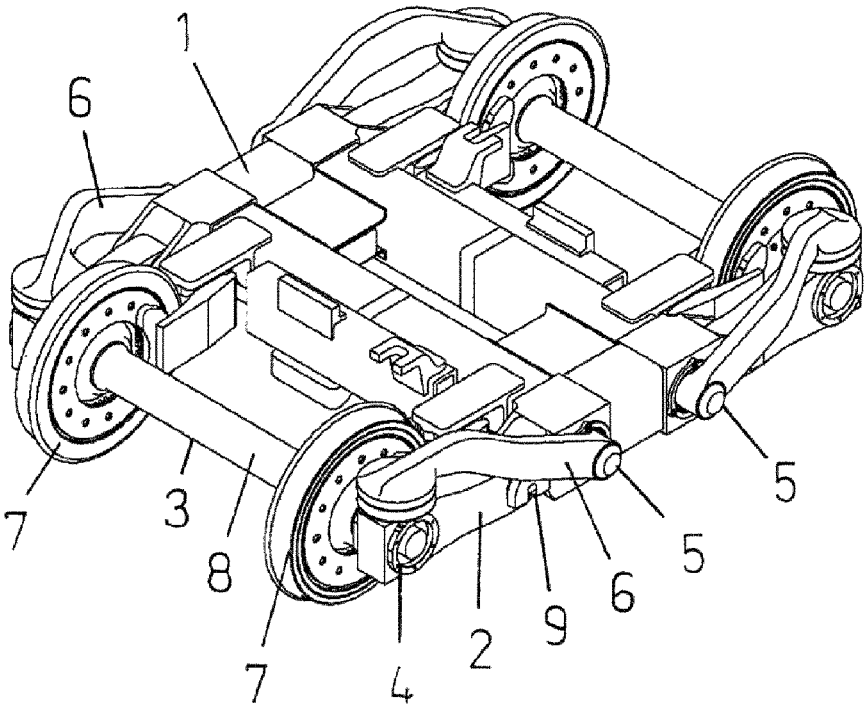

transverse member. The bogies are in particular characterized in that they have a lightweight design and can be produced at low cost. The axleboxes of a wheelset are articulated to the transverse member via two axle levers so that the axle levers form an H shape with the axleboxes and the transverse member. The transverse member has at least two torsion bars arranged in parallel to the axles of the wheelsets, said torsion bars being firmly connected to the transverse member. The torsion bars have spring levers so that the end portion of the spring lever not connected to the torsion bar acts upon the axlebox.

16 Claims, 6 Drawing Sheets

(56) References Cited

U.S. PATENT DOCUMENTS 4,448,131 A * 5/1984 Weiland ..... B61F 5/00 105/182.1
4,773,334 A * 9/1988 Nowak ..... B61F 5/523 105/182.1
5,222,442 A * 6/1993 Tack, Jr. ..... B61F 5/36 105/179
2012/0279416 A1* 11/2012 Nishimura ..... B61F 5/302 105/218.1
2019/0322296 A1* 10/2019 Ma ..... B61F 3/02

FOREIGN PATENT DOCUMENTS

| | | | |
|---|---|---|---|
| DE | 1913784 | A1 | 10/1970 |
| DE | 7121742 | U | 12/1971 |
| DE | 2952182 | A1 | 7/1981 |
| DE | 3612797 | C1 | 8/1987 |
| EP | 2733041 | A1 | 5/2014 |
| GB | 1311965 | A | 3/1973 |
| GB | 1330919 | A | 9/1973 |

OTHER PUBLICATIONS

First Office Action corresponding to Priority Application No. 10 2016 123 784.1; dated Aug. 25, 2017.

* cited by examiner

BOGIE OF A RAIL VEHICLE WITH AT LEAST TWO WHEELSETS MOUNTED IN AXLEBOXES AND AT LEAST ONE TRANSVERSE MEMBER

CROSS-REFERENCE TO RELATED APPLICATIONS

This application is the national phase of International Application No. PCT/EP2017/081853, titled "BOGIE OF A RAIL VEHICLE WITH AT LEAST TWO WHEELSETS MOUNTED IN AXLEBOXES AND AT LEAST ONE TRANSVERSE MEMBER", filed on Dec. 7, 2017, which claims the priority of German patent application No. 102016123784.1 filed on Dec. 8, 2016, the entire disclosures of the applications are incorporated herein by reference.

The invention relates to bogies for rail vehicles with at least two wheel sets mounted in axle box bearings and at least one cross member.

Conventional bogies for rail vehicles with a steel construction in which the primary suspension is usually provided by plate springs, coil springs or rubber-metal springs have added disadvantages in addition to their own heavy weight due to the fact that they consist of many individual parts and there is little installation space available for components like drives, control devices and brakes.

In order to reduce the weight, bogies with a fibre composite construction in which the primary suspension is realized by the bogie frame or by plate springs with a fibre composite construction are known from the state of the art.

There is disclosed in DE 29 52 182 A1 a bogie in which the bogie frame is composed of a resiliently elastic fibre-reinforced material and assumes the task of the primary suspension.

Known for example from US 2012/0279416 are bogies the primary suspension of which is provided by separate plate springs with a fibre composite construction. In particular the connection of the spring elements to the other components of the bogie frame proves difficult here.

DE 36 12 797 A1 discloses a bogie in which the primary suspension is provided by longitudinal members of a double-H-shaped bogie frame which are designed with a fibre composite construction. The bogie also has a torsion-elastic plate as frame stiffening element which connects the longitudinal members to each other. Disadvantageously, the torsion-elastic plate and in particular the longitudinal members have a complicated fibre composite structure as e.g. the elasticity behaviour of the longitudinal members must change in a defined manner in longitudinal direction perpendicular to the bogie plane in order to fulfil the spring properties.

Torsion bar suspensions are known from the motor vehicle domain and from the tracked vehicle domain, e.g. from DE 920 291 and U.S. Pat. No. 4,194,761. Furthermore, torsion bars are used as stabilizers in running gears and are customarily designed there as bars with multiple bends which connect the wheel suspensions of the wheels of an axle and the running gear structure to each other. Stabilizers serve to reduce the angle of roll of a coach body.

The object of the invention specified in claim 1 is to create an alternative design variant for a bogie of a rail vehicle such that it can be designed with a lightweight construction and can be manufactured at low cost.

This object is achieved with the features listed in claim 1.

The bogies as components of rail vehicles with at least two wheel sets mounted in axle box bearings and at least one cross member are characterized in particular in that they can be designed with a lightweight construction and can be manufactured at low cost.

For this, the axle box bearings of a wheel set are connected in an articulated manner to the cross member via two axle levers, with the result that the axle levers form an H shape with the axle box bearings and the cross member. The cross member has at least two torsion bars which are arranged parallel to the axles of the wheel sets and are securely connected to the cross member. Furthermore, the torsion bars have spring levers, with the result that the end area of the spring lever not connected to the torsion bar acts on the axle box bearing.

The bogie of a rail vehicle has at least two wheel sets each wheel set of which comprises two wheels connected to an axle. The wheel set is mounted in axle box bearings which are furthermore connected in an articulated manner to the cross member via the axle levers. In the bogie formed according to the invention, two spring levers connected to the torsion bar act on the axle box bearings of the wheel set, with the result that advantageously the primary suspension is at least partly assumed by the torsion bars acting on the axle box bearings. Using these torsion bars as straight torsion springs, the primary suspension is thus based on a rotational spring movement instead of on a known translational spring movement.

The geometry and the material of the torsion bars can be adapted in defined manner to the loads to be expected.

Because the axle box bearings are located in the axle levers connected in an articulated manner to the cross member, the cross member, and thus the coach body connected thereto, is arranged spring-loaded. Thus the axle levers arranged in an articulated manner can also contribute to the secondary suspension of the rail vehicle.

Advantageously, the proposed bogie comprises geometrically uncomplicated individual structures which can also be realized with a lightweight construction at least partly at low cost.

Advantageous embodiments of the invention are specified in claims 2 to 10.

In a development of the invention according to claim 2, two torsion bars are arranged one after the other in axial direction on the cross member. The ends facing each other of the torsion bars are connected with their end areas to the cross member. Furthermore, the other ends of the torsion bars have a spring lever.

According to the development of claim 3, the cross member has an H shape. The end areas of a torsion bar loosely penetrate the opposite arms of the H-shaped cross member. For this, the arms of the cross member can be formed as guides or radial bearings for the torsion bar. The central area of the torsion bar is securely connected to the H-shaped cross member. Furthermore, in each case an axle lever is connected in an articulated manner to an end of the arm of the cross member, with the result that the axle lever joint is part of the cross member. The axle levers thus extend the arms of the H-shaped cross member.

According to the development of claim 4, one end area of a torsion bar is located as movable part at or in at least one radial bearing connected to the cross member. The end area of the torsion bar penetrates the radial bearing and the end of the torsion bar after the radial bearing comprises the spring lever. The radial bearings for one torsion bar or two torsion bars arranged one after the other can thus be located between the axle levers or in the area of the axle levers. Thus the spring levers can be arranged above the axle levers relative to the rails bearing and guiding the wheel sets.

There, the end areas of the spring levers can act on the end areas of the axle levers with the axle box bearings.

According to the development of claim 5, the torsion bar has the shape of a conic section and/or a polygon in cross section. Thus the torsion bar can also have profiles along its length. Thus an optimum connection and load application of the spring lever to the cross member can be effected. A profile can furthermore be present along the free length of the torsion bars to optimize the mechanical properties in dynamic operation.

According to the development of claim 6, the torsion bars and/or the spring levers are designed from a metal or a fibre composite material or with a composite construction. Because of the light weight, the design with a fibre composite construction is particularly advantageous. In particular, glass fibres or carbon fibres or aramid fibres can be used here.

According to the development of claim 7, advantageously at least one damper is located between the end areas of the axle lever and the spring lever. The dampers of the bogie are further spring elements of the primary suspension and the secondary suspension.

According to the development of claim 8, the damper consists of an elastomer. In particular this can be a rubber.

According to the development of claim 9, the cross member is a base body with the elements for the pivot joints of the axle levers and with fixing elements for attachment parts. The base body consists of a metal and/or a fibre composite material. Attachment parts here can be in particular braking devices and/or drives.

According to the development of claim 10, the cross member is a beam or a frame.

According to the development of claim 11, the bogie has further spring elements for the secondary suspension and a bogie pivot. The further spring elements assume the task of secondary suspension of the coach body. In particular air springs which are arranged on the cross member can be provided for this.

Embodiment examples of the invention are represented in principle in the drawings and described in more detail in the following.

Figure 2:
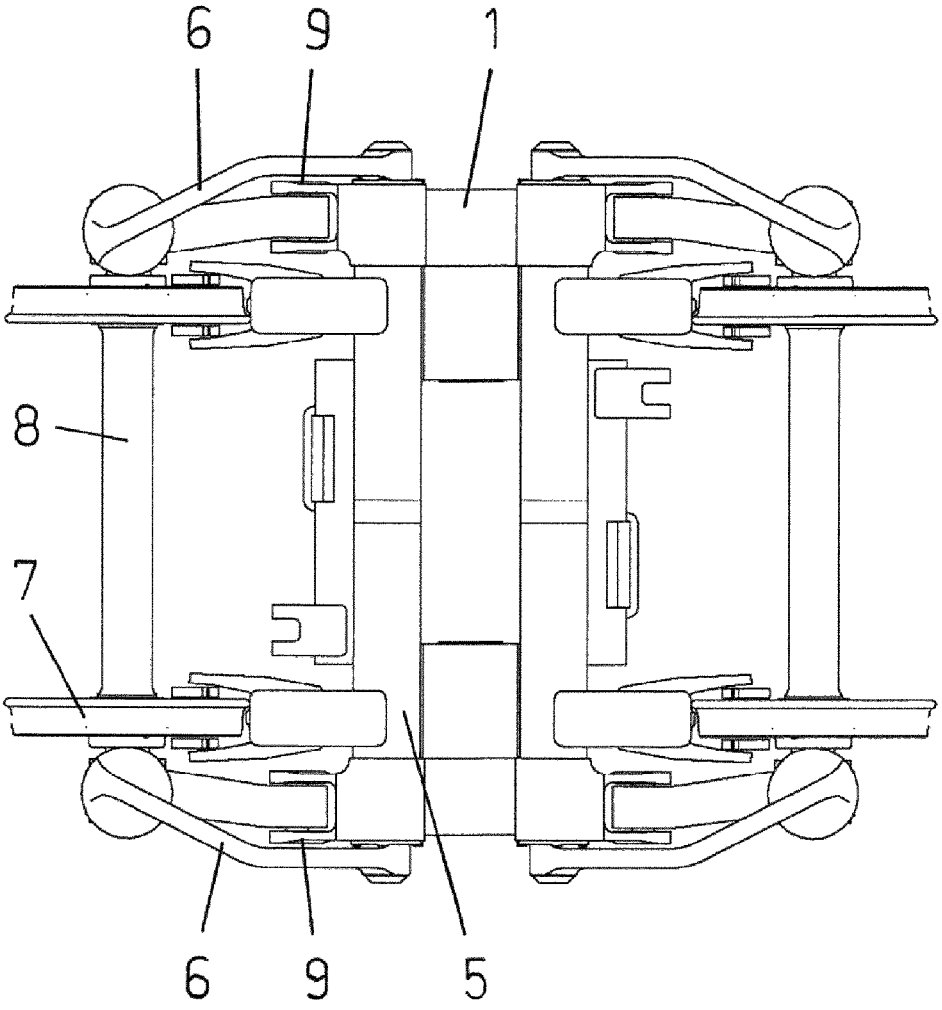
Figure 3:
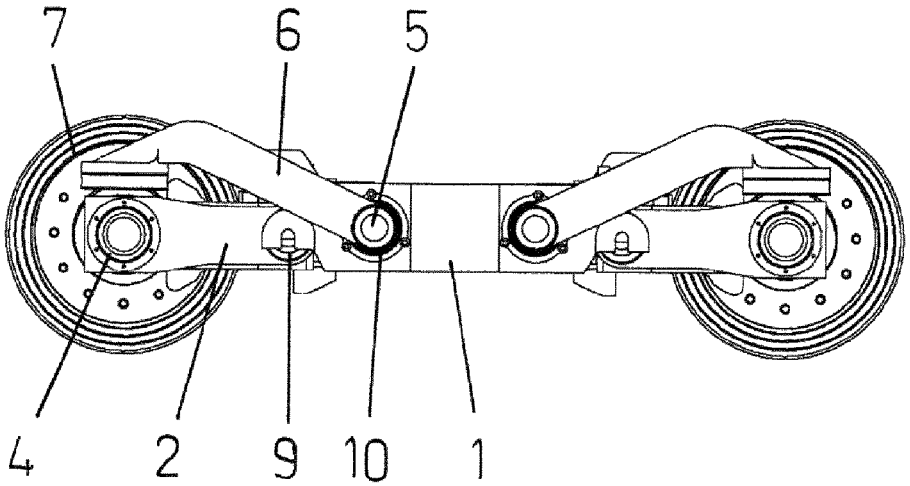
Figure 4:
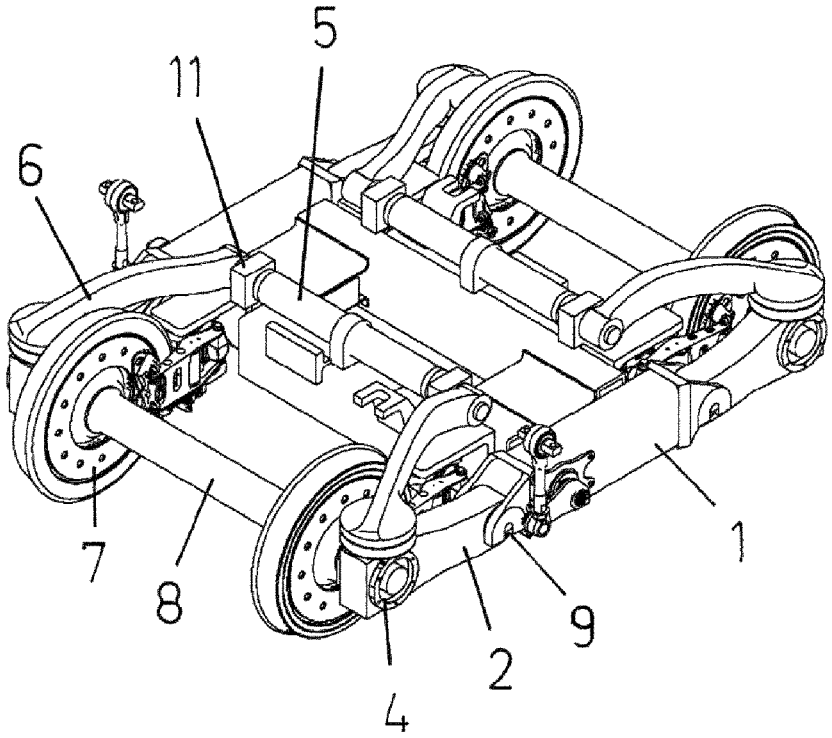
Figure 5:
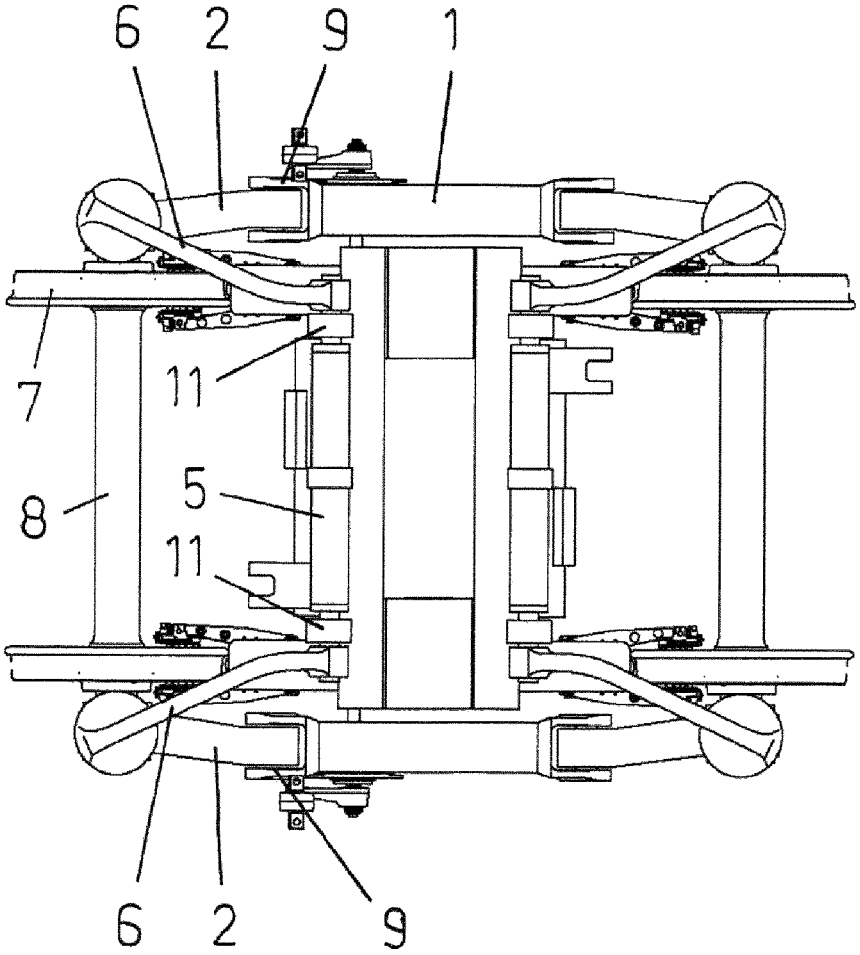
Figure 6:
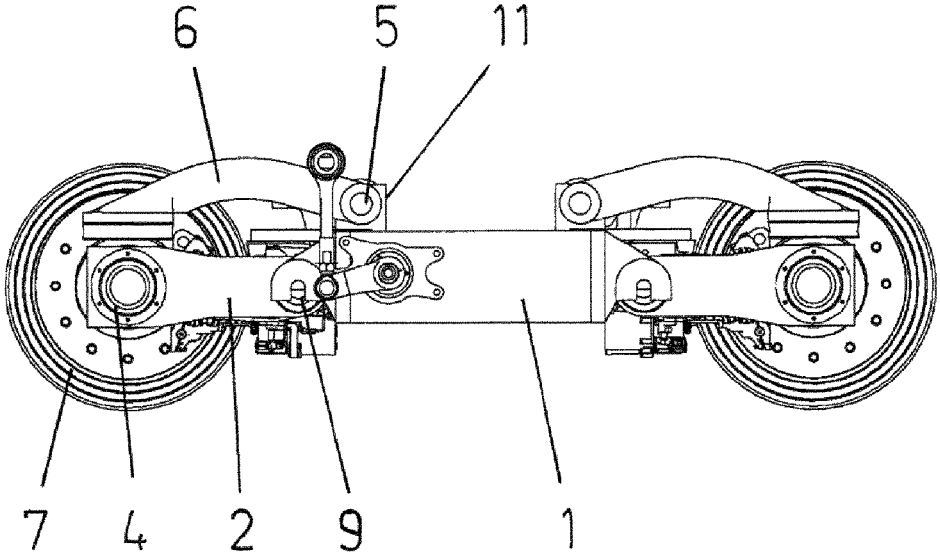

There are shown in:

FIG. 1 a perspective view of a bogie of a rail vehicle with spring levers lying outside, FIG. 2 a top view of the bogie, FIG. 3 a side view of the bogie, FIG. 4 a perspective view of a bogie of a rail vehicle with spring levers lying inside, FIG. 5 a top view of the bogie and FIG. 6 a side view of the bogie.

A bogie of a rail vehicle consists substantially of two wheel sets 3 mounted in axle box bearings 4, a cross member 1, axle lever 2, torsion bars 5, spring levers 6 and a bogie pivot.

FIG. 1 shows a perspective view in principle of a bogie of a rail vehicle with spring levers 6 lying outside.

The bogie has two wheel sets 3 each with two wheels 7 on a common axle 8. The axle 8 is connected in an articulated manner to the cross member 1 via the axle box bearings 4, two axle levers 2 and two axle lever joints 9 formed as pivot joints. The cross member 1 is a frame which forms an H shape with the axle lever joints 9 and the axle levers 2 with the axle box bearings 4.

FIG. 2 shows a top view in principle of the bogie from FIG. 1.

The cross member 1 has the at least two torsion bars 5 arranged parallel to the axles 8 of the wheel sets 3. The respective central area of the torsion bars 5 is connected to the cross member 1. The end of the torsion bar 5 comprises the spring lever 6, wherein the end of the spring lever 6 acts on the axle box bearing 4. Thus the torsion bars 5 and the spring levers 6 are the primary suspension or a part of the primary suspension of the bogie.

FIG. 3 shows a side view in principle of the bogie from FIG. 1.

The end area of the torsion bar 5 penetrates the arm of the H-shaped cross member 1. For this, the latter has an opening 10. Here, the torsion bar 5 can be mounted in the cross member 1. The axle lever joints 9 are components of the H-shaped cross member 1, wherein the axle levers 2 extend the arms of the H-shaped cross member 1.

The torsion bar 5 is formed circular and/or polygonal in cross section. For this, it can have profiles along its length. The torsion bars 5 and the spring levers 6 can advantageously consist of a fibre composite material.

The central area of the torsion bar 5 can be located in a rotationally fixed manner in a sleeve as part of the cross member 1. For this, at least this central area and the opening of the sleeve are formed polygonal in cross section. The end areas of the torsion bar 5 each penetrate the opening 10 on both arms and comprise the spring levers 6. Here, the torsion bar 5 and the spring levers 6 can also be formed in one piece. The openings 10 can each be a guide or a radial bearing for the respective area of the torsion bar 5.

FIG. 4 shows a perspective view in principle of a bogie of a rail vehicle with spring levers 6 lying inside.

In this alternative embodiment, the fixed components of the guides or the radial bearings 11 can also be connected to the cross member 1.

FIG. 5 shows a top view in principle of the bogie from FIG. 4.

The guides or the radial bearings 11 can thus be located between the axle levers 2.

FIG. 6 shows a side view in principle of the bogie from FIG. 4.

The guides or the radial bearings 11 are arranged spaced apart above the axle levers 2 relative to the rails which accommodate and guide the wheel sets 3, with the result that the ends of the spring levers 6 thus act on the end areas of the axle levers 2 and thus on the axle box bearings 4. Instead of one guide or one radial bearing 11, two guides or two radial bearings can also be arranged spaced apart from each other, with the result that the spring lever 6 can be located between same.

At least one damper made of an elastomer, which can consist in particular of rubber, can be located between the end areas of the axle lever 2 and of the spring lever 6.

The cross member 1 represents a base body with the elements for the axle lever joints 9 and with fixing elements for attachment parts. For this, the base body can consist of a metal and/or a fibre composite material and thus also be realized with a composite construction.

Attachment parts can be for example air springs as spring element and thus components of a secondary suspension, braking devices for the wheels 7 and drives.

REFERENCE NUMBERS

1 cross member
2 axle lever
3 wheel set
4 axle box bearing
5 torsion bar
6 spring lever

7 wheel
8 axle
9 axle lever joint
10 opening
11 radial bearing

The invention claimed is:

1. A bogie of a rail vehicle with at least two wheel sets mounted in axle box bearings and at least one cross member, wherein the axle box bearings of a wheel set are connected in an articulated manner to the cross member via two axle levers, with the result that the axle levers form an H shape with the axle box bearings and the cross member, that the cross member has at least two torsion bars arranged parallel to the axles of the wheel sets, that the torsion bars have at least one area in which they are connected in a rotationally fixed manner to the cross member, and that the torsion bars have spring levers such that the end area, not connected to the torsion bar, of the spring lever acts on the axle box bearing.

2. The bogie according to claim 1, wherein two torsion bars are arranged one after the other in longitudinal direction on the cross member, that the ends facing each other of the torsion bars are connected with their end areas to the cross member and that the other ends of the torsion bars comprises the spring levers.

3. The bogie according to claim 2, wherein the cross member has an H shape in cross section, that the end areas of a torsion bar loosely penetrate the opposite arms of the cross member, that the central area of the torsion bar is securely connected to the cross member and that an axle lever each is connected in an articulated manner to an end of the arm of the cross member, with the result that the axle lever joints are components of the cross member.

4. The bogie according to claim 2, wherein an end area of a torsion bar is located as movable part in at least one radial bearing connected to the cross member, that the end area of the torsion bar penetrates the radial bearing and that the end of the torsion bar after the radial bearing comprises the spring lever.

5. The bogie according to claim 2, wherein the torsion bars and/or the spring levers consist of a metal or a fibre composite material or have a composite construction of at least one metal and at least one fibre composite material.

6. The bogie according to claim 1, wherein the cross member has an H shape in cross section, that the end areas of a torsion bar loosely penetrate the opposite arms of the cross member, that the central area of the torsion bar is securely connected to the cross member and that an axle lever each is connected in an articulated manner to an end of the arm of the cross member, with the result that the axle lever joints are components of the cross member.

7. The bogie according to claim 6, wherein the torsion bars and/or the spring levers consist of a metal or a fibre composite material or have a composite construction of at least one metal and at least one fibre composite material.

8. The bogie according to claim 1, wherein an end area of a torsion bar is located as movable part in at least one radial bearing connected to the cross member, that the end area of the torsion bar penetrates the radial bearing and that the end of the torsion bar after the radial bearing comprises the spring lever.

9. The bogie according to claim 8, wherein the torsion bars and/or the spring levers consist of a metal or a fibre composite material or have a composite construction of at least one metal and at least one fibre composite material.

10. The bogie according to claim 1, wherein the torsion bar has the shape of a conic section and/or of a polygon in cross section.

11. The bogie according to claim 1, wherein the torsion bars and/or the spring levers consist of a metal or a fibre composite material or have a composite construction of at least one metal and at least one fibre composite material.

12. The bogie according to claim 1, wherein at least one damper is located between the end areas of the axle lever and the spring lever.

13. The bogie according to claim 12, wherein the damper consists of an elastomer.

14. The bogie according to claim 1, wherein the cross member is a base body with the elements for the axle lever joints of the axle levers and with fixing elements for attachment parts and that the base body consists of a metal and/or a fibre composite material.

15. The bogie according to claim 1, wherein the cross member is a beam or a frame.

16. The bogie according to claim 1, wherein the bogie has further spring elements for secondary suspension and a bogie pivot.

* * * * *